US005539436A

United States Patent [19]

Wilson et al.

[11] Patent Number: 5,539,436

[45] Date of Patent: Jul. 23, 1996

[54] MODULAR CARRIAGE ASSEMBLY FOR AN INKJET PRINTER

[75] Inventors: Arthur K. Wilson, San Diego; Corrina Hall; W. Wistar Rhoads, both of Escondido, all of Calif.

[73] Assignee: Hewlett-Packard Company, Palo Alto, Calif.

[21] Appl. No.: 431,395

[22] Filed: Apr. 28, 1995

Related U.S. Application Data

[63] Continuation of Ser. No. 55,618, Apr. 30, 1993, abandoned.

[51] Int. Cl.[6] ..... B41J 23/00

[52] U.S. Cl. ..... 347/37; 347/49; 347/50; 400/357

[58] Field of Search ..... 361/749, 789; 347/37, 49, 50, 86, 87, 39, 58; 400/357

[56] References Cited

U.S. PATENT DOCUMENTS

| | | | |
|---|---|---|---|
| 4,074,284 | 2/1978 | Dexter et al. | 346/140 R |
| 4,755,836 | 7/1988 | Ta et al. | 347/50 |
| 4,775,868 | 10/1988 | Sugiura | 346/140 X |
| 4,827,294 | 5/1989 | Hanson | 346/140 R |
| 4,878,070 | 10/1989 | Watrobski | 346/140 R |
| 4,940,998 | 7/1990 | Asakawa | 346/140 R |

*Primary Examiner*—John E. Barlow, Jr.

[57] ABSTRACT

An improved modular carriage assembly for an inkjet printer including: a carriage with at least two stalls molded therein for holding a plurality of inkjet pens; and a removable frame insertable in a compartment in the carriage adjacent to the stall for holding an electrical circuit. In a specific embodiment the improved modular carriage assembly includes at least two extensions molded onto the removable frame. When the removable frame is inserted into the compartment each of the extensions is inserted into a respective stall. A method of assembling a carriage assembly for an inkjet printer with inkjet pens includes the steps of: attaching an electrical circuit to a frame; positioning a unitary clamp on a carriage; and installing the frame with attached electrical circuit to the carriage. Installing the frame on the carriage holds the unitary clamp in place on the carriage. Another specific method of assembling a carriage assembly includes the steps of: removably attaching a circuit to the frame; removably attaching an interconnect device to the circuit; and wrapping the interconnect device over the frame for interconnecting the circuit to inkjet pens. The improved modular carriage assembly has reduced cost and is easier to assemble, align and service without the need for any special tools.

10 Claims, 10 Drawing Sheets

FIG. 2a
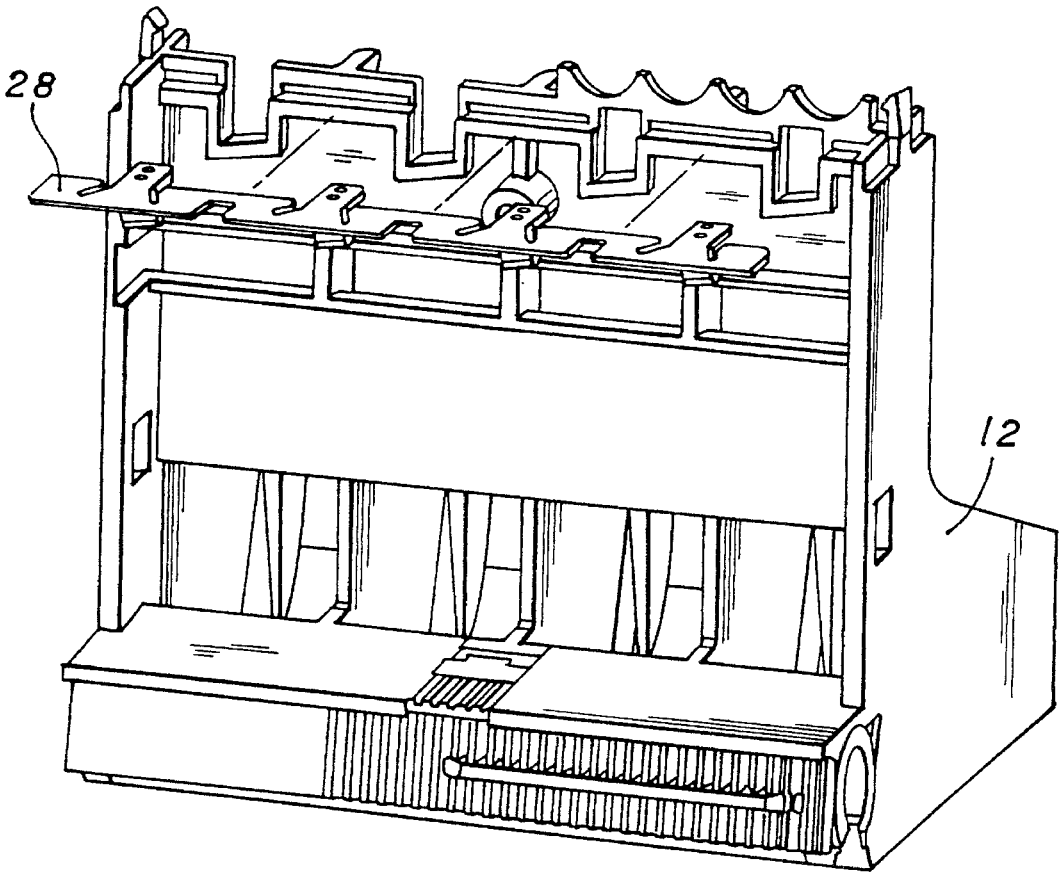
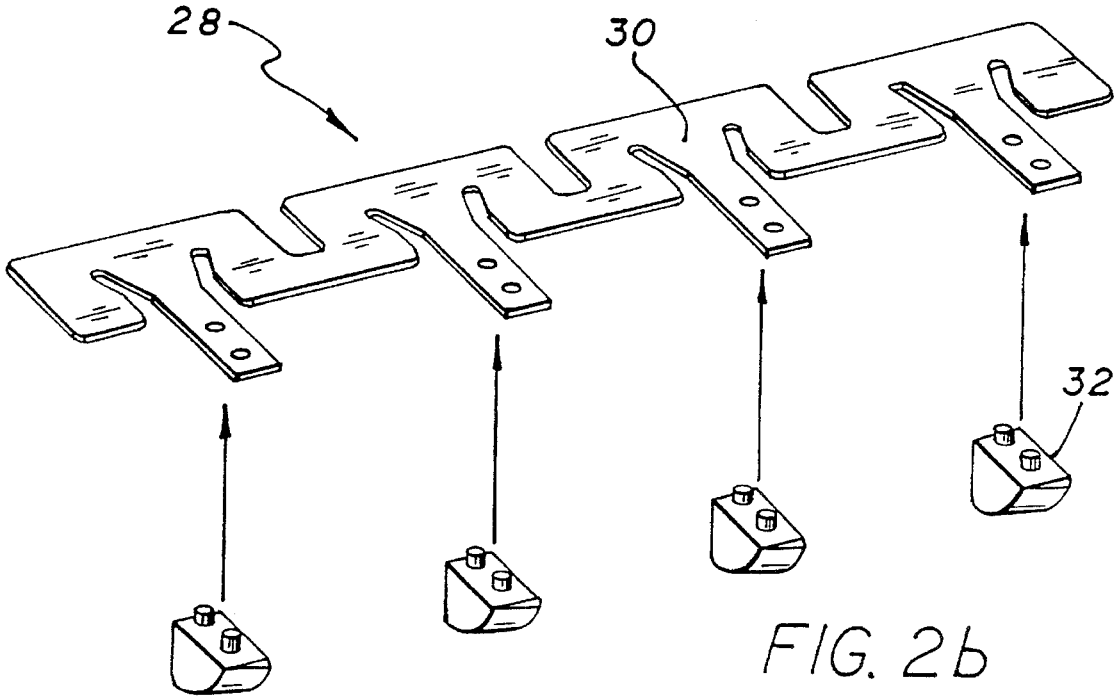
FIG. 2b

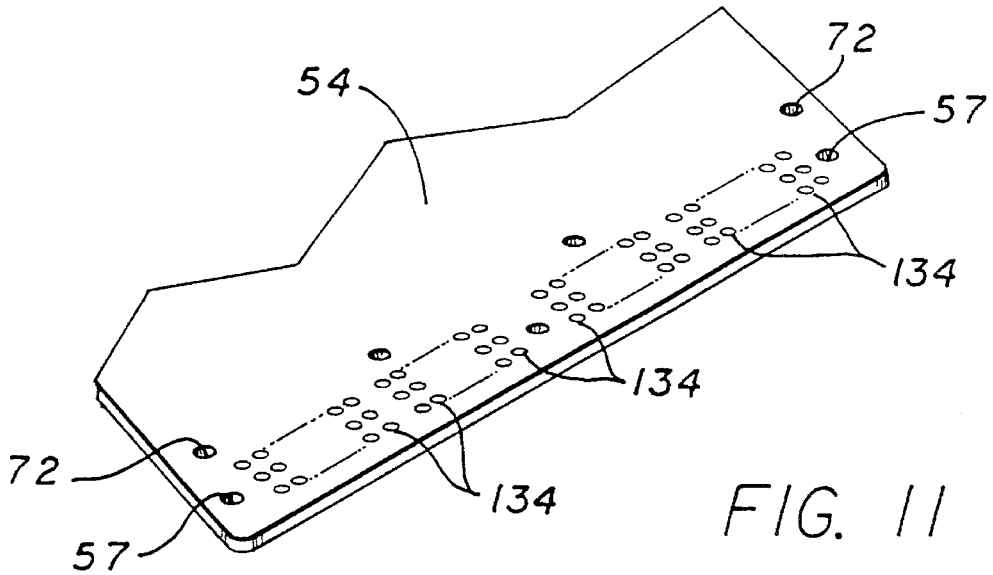
FIG. 11
FIG. 12
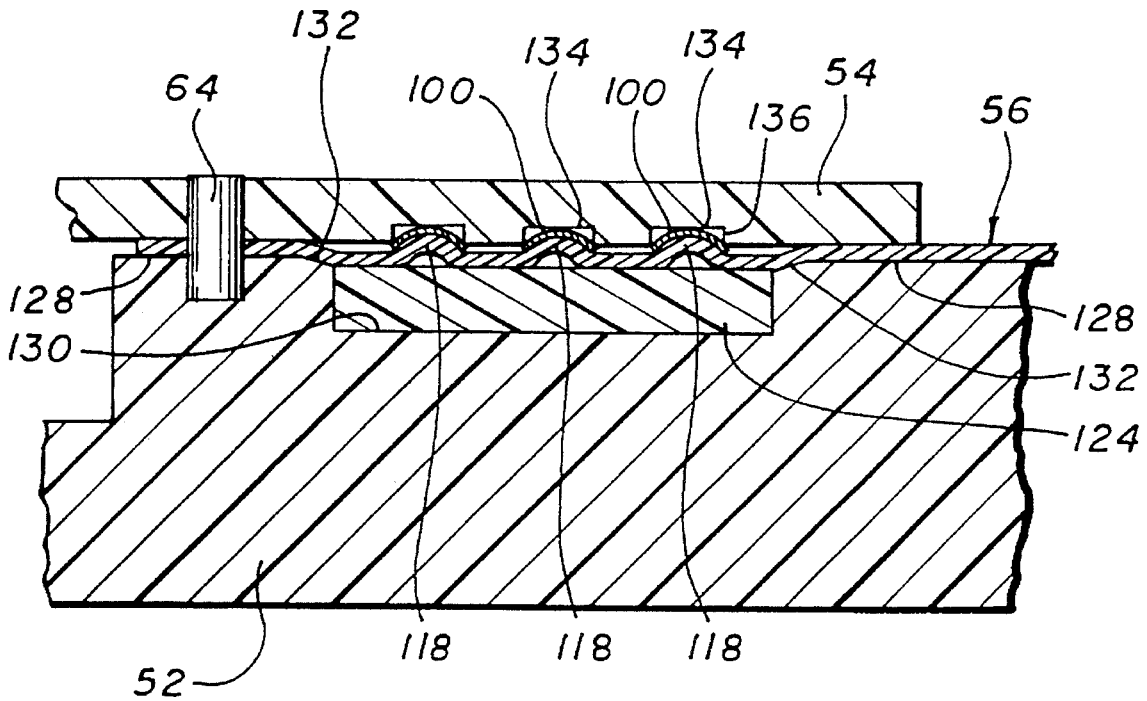

MODULAR CARRIAGE ASSEMBLY FOR AN INKJET PRINTER

This is a Continuation of application Ser. No. 08/055,618, filed Apr. 30, 1993, now abandoned.

BACKGROUND OF THE INVENTION

1. Field of the Invention

This invention relates to carriage assemblies and more particularly to carriage assemblies for multiple inkjet pens in a color inkjet printer.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Inkjet printer/plotters and desktop printers, such as those sold by Hewlett Packard Company, offer substantial improvements in speed over conventional X-Y plotters and printers. Inkjet printer/plotters typically include a pen having an array of nozzles. The pens are mounted on a carriage which is moved across the page in successive swaths. Each inkjet pen has heater circuits which, when activated, cause ink to be ejected from associated nozzles. As the pen is positioned over a given location, a jet of ink is ejected from the nozzle to provide a pixel of ink at a desired location. The mosaic of pixels thus created provides a desired composite image.

Inkjet technology is now well known in the art. See, for example, U.S. Pat. Nos. 4,872,027, entitled PRINTER HAVING IDENTIFIABLE INTERCHANGEABLE HEADS, issued Oct. 3, 1989, to W. A. Buskirk et al. and 4,965,593, entitled PRINT QUALITY OF DOT PRINTERS, issued Oct. 23, 1990, to M. S. Hickman, the teachings of which are incorporated herein by reference.

Recently, full color inkjet printer/plotters and desktop printers have been developed which comprise a plurality of inkjet pens of diverse colors. A typical color inkjet printer/plotter has four inkjet pens, one that stores black ink, and three that store colored inks, e.g., magenta, cyan and yellow. The colors from the three color pens are mixed to obtain any particular color.

The pens are typically mounted in stalls within an assembly which is mounted on the carriage of the printer/plotter. The carriage assembly positions the inkjet pens and typically holds the circuitry required for interfacing to the heater circuits in the inkjet pens.

Conventionally, a carriage assembly consists of four pen stalls to align the inkjet pens, four pen clamps to hold the inkjet pens in the pen stalls, a printed circuit board having the circuitry for interfacing to the heater circuits in the inkjet pens, and four separate flexible circuits interconnected between the printed circuit board and electrical contacts on the inkjet pens. Each of these separate parts are conventionally assembled piece by piece with screws fastening the parts individually to a housing to form a carriage assembly. Assembly of these individual parts is a difficult and expensive process and special tools are required to properly align the parts. The carriage assembly moves during printing and for quick responsiveness, it is required that the overall carriage assembly be lightweight, which results in a relatively fragile carriage assembly. If a conventional carriage assembly is accidentally bumped or one of its components fails, then repair for a conventional carriage assembly is costly, because of the multitude of individual parts and the difficult alignment process.

Conventionally, in a carriage assembly, a separate flexible circuit is used to interconnect each inkjet pen to the associated printed circuit board. The flexible circuit is made with a polyester or polyimid material such as Mylar or Kapton onto which multiple conductors are deposited. A color inkjet printer with four inkjet pens requires four separate flexible circuits. The use of separate flexible circuits has the disadvantages of: 1) high cost, due to the need to manufacture and stock the separate flexible circuits; 2) difficulty of assembly, because of the need to route and precisely align in the carriage assembly each of the separate flexible circuits to each of the inkjet pen housings; and 3) cost of assembly because the separate flexible circuits need to be separately interconnected with the printed circuit board.

Accordingly, there is a need in the art for a carriage assembly that has reduced cost and is easier to assemble, align and service.

SUMMARY OF THE INVENTION

The need in the art is addressed by an improved carriage assembly for an inkjet printer of the present invention. The inventive assembly includes a carriage with at least two stalls molded therein for holding a plurality of inkjet pens. A removable frame is insertable into a compartment in the carriage adjacent to the stalls for holding an electrical circuit.

In a specific embodiment the improved modular carriage assembly includes at least two extensions molded onto the removable frame. When the removable frame is inserted into the compartment each of the extensions is inserted into a respective stall.

In another specific embodiment the improved modular carriage assembly includes a circuit coupled to the removable frame for interfacing to the inkjet pens. An interconnect device is coupled to the circuit and wrapped around the extensions for interconnecting the circuit to the inkjet pens. When an inkjet pen is installed in a stall the interconnect device is coupled to the inkjet pen.

In another specific embodiment an improved carriage of one piece construction for retaining at least two inkjet print cartridges in a fixed relation includes a first portion extending along a first axis and adapted to engage a carriage bar of an inkjet printer along the first axis. At least two second portions, each extending along a second axis, are substantially transverse to and integral with the first portion and retain the first and second inkjet print cartridges in a fixed relation. A third portion, extending along a third axis, is substantially transverse to and integral with the first and second portions and adapted to retain a substantially planar removable element within a plane defined by the first and third axes.

A method of assembling a carriage assembly for an inkjet printer with inkjet pens includes the steps of attaching an electrical circuit to a frame and positioning a unitary clamp on the carriage. The next step is installing the frame with attached electrical circuit to the carriage, which also holds the unitary clamp in place on the carriage.

Another specific method of assembling a carriage assembly includes the step of removably attaching a circuit to the frame. The next step is removably attaching an interconnect device to the circuit and to the frame for interconnecting the circuit to the inkjet pens.

An alternate specific method of assembling a carriage assembly includes the step of removably attaching the frame with attached electrical circuit to the carriage.

The improved modular carriage assembly has reduced cost and is easier to assemble, align and service without the need for any special tools.

BRIEF DESCRIPTION OF THE DRAWINGS

FIGS. 2*a* and 2*b* are illustrative diagrams showing spring mechanisms for clamping the inkjet pens in a unitary housing in accordance with the present invention.

FIG. 11 is an illustrative diagram showing contacts on a circuit board corresponding to contacts on a unitary interconnect constructed in accordance with the present invention.

FIG. 12 is an illustrative diagram of an elevation section along line 12—12 of FIG. 10 of an assembled improved electrical interconnect system for a unitary interconnect constructed in accordance with the present invention.

DESCRIPTION OF THE INVENTION

Illustrative embodiments and exemplary applications will now be described with reference to the accompanying drawings to disclose the advantageous teachings of the present invention.

Figure 1A:
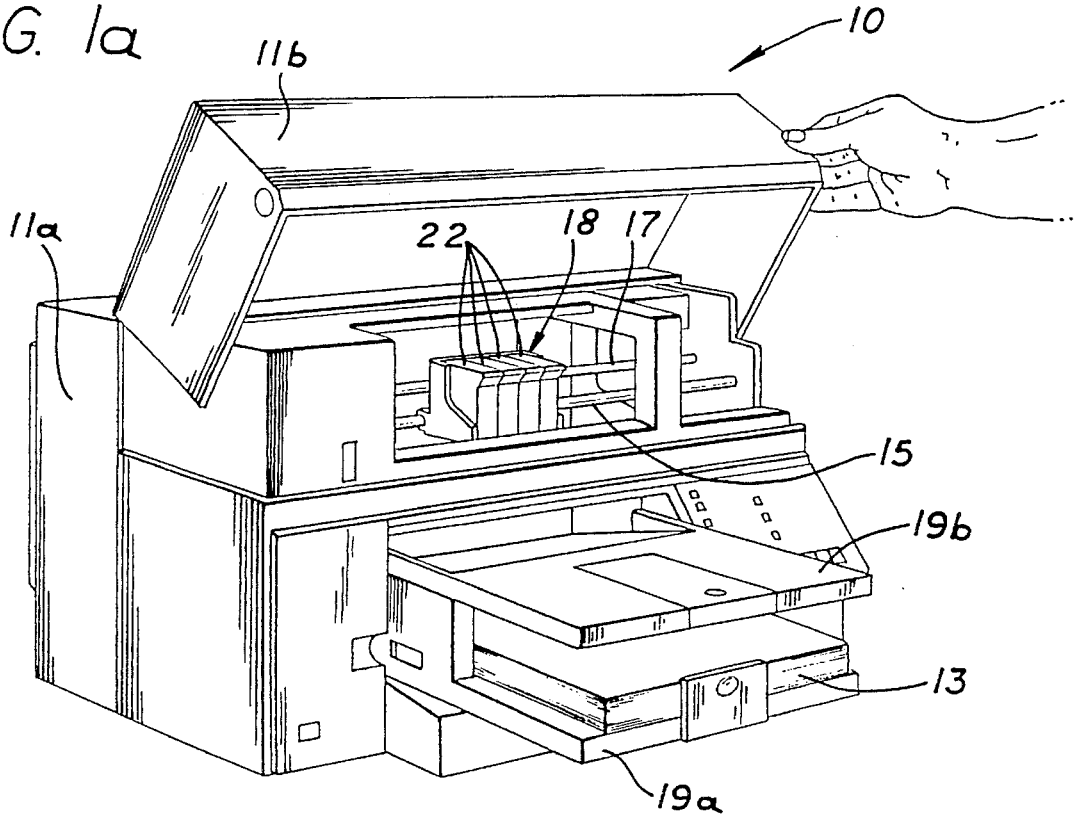
FIGS. 1*a* through 1*c* are illustrative diagrams showing a thermal inkjet printer, inkjet pen and inkjet pens installed in a unitary housing in accordance with the present invention.

FIG. 1 is a perspective view of a thermal inkjet desktop printer incorporating the teachings of the present invention. The printer 10 includes a housing 11*a* and a protective front access lid 11*b*. A carriage assembly 18, which has four inkjet pens 22, is adapted for reciprocal motion along carriage bar 15. The position of the carriage assembly 18 in the carriage scan axis along carriage bar 15 is determined by a carriage positioning mechanism (not shown) on the carriage assembly 18 that senses its position relative to carriage encoder strip 17. An input tray 19*a* holds a media input stack 13 and after printing the printed media is held by an output tray 19*b*.

Figure 1B:
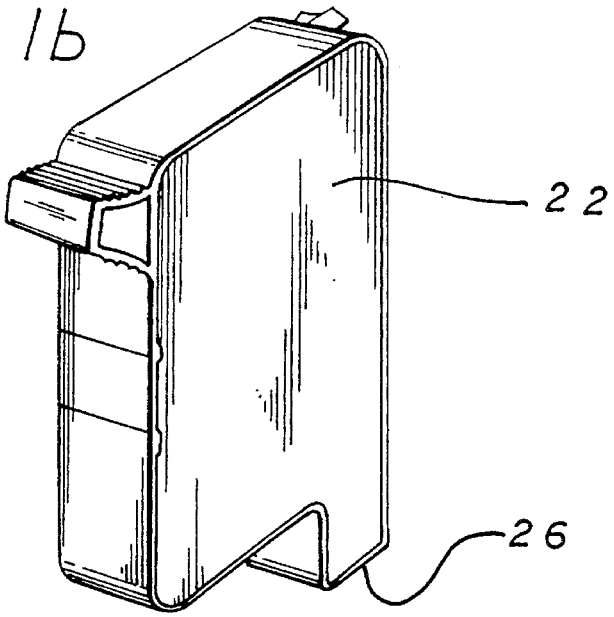
Figure 1C:
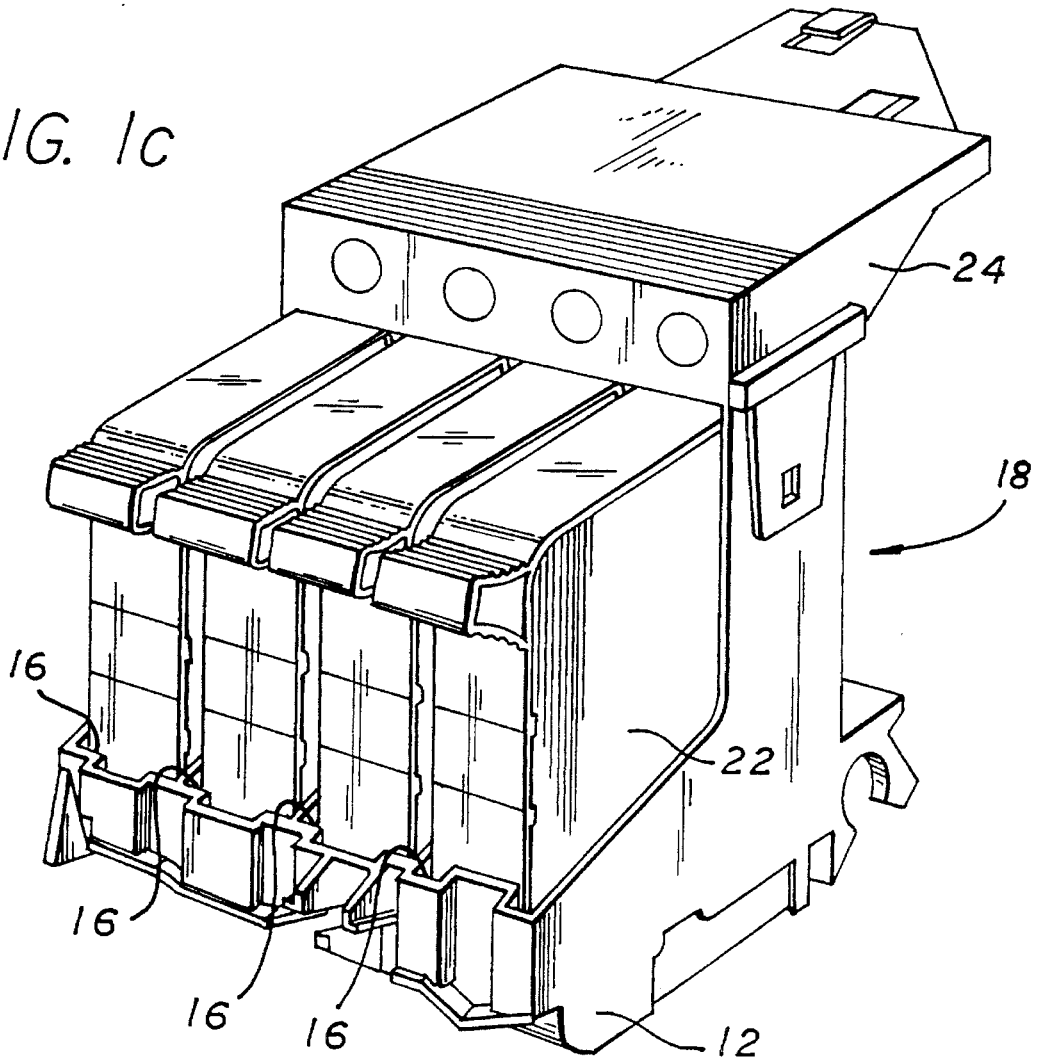

A color inkjet printer/plotter has four inkjet pens 22, one that stores black ink, and three that store colored inks, e.g., magenta, cyan and yellow. The colors from the three color pens are mixed to obtain any particular color. FIG. 1*b* is a detailed illustration of an inkjet pen 22 that includes heater circuits, which when activated cause ink to be ejected from the inkjet pen 22 at end 26. FIG. 1*c* illustrates carriage assembly 18 including four inkjet pens 22 installed in four pen stalls 16 in unitary housing 12 with cover 24 placed on top.

The inkjet pens 22 are held in unitary housing 12 by unitary spring clamp assembly 28, which is installed onto unitary housing 12, as shown in FIG. 2*a*. The tops of the inkjet pens 22 are retained by cam clamps 32 on unitary spring clamp assembly 28 when the inkjet pens 22 are inserted into unitary housing 12. FIG. 2*b* shows the position of cam clamps 32 on spring 30 to form unitary spring clamp assembly 28.

Figure 3A:
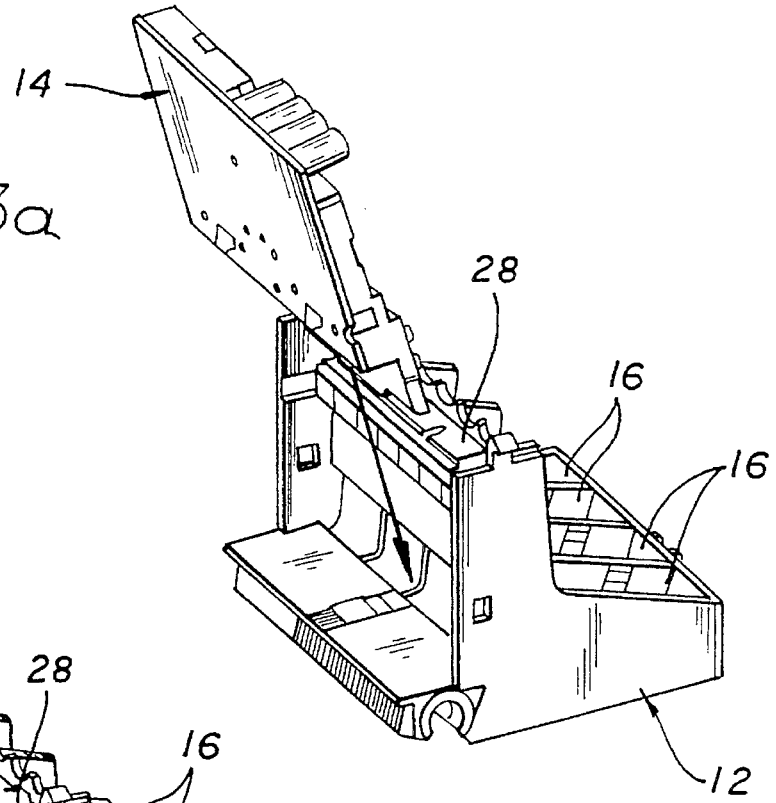
FIGS. 3*a* through 3*c* are illustrative diagrams of an improved carriage assembly showing the coupling of a removable frame circuit assembly to a unitary housing in accordance with the present invention.
Figure 3B:
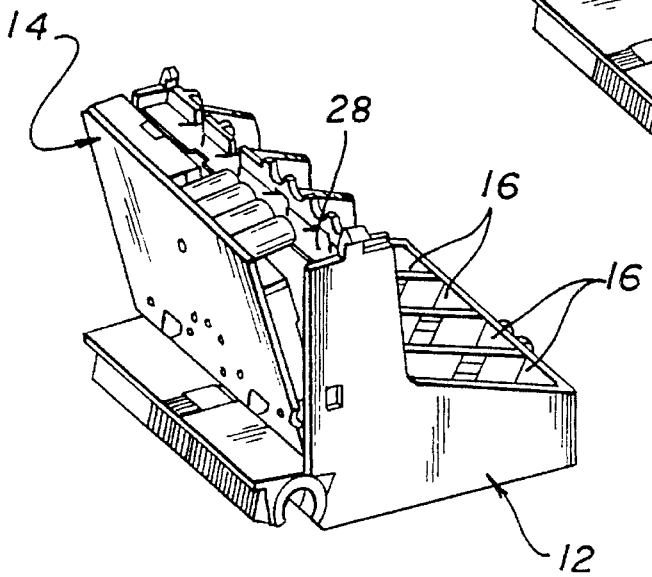
Figure 3C:
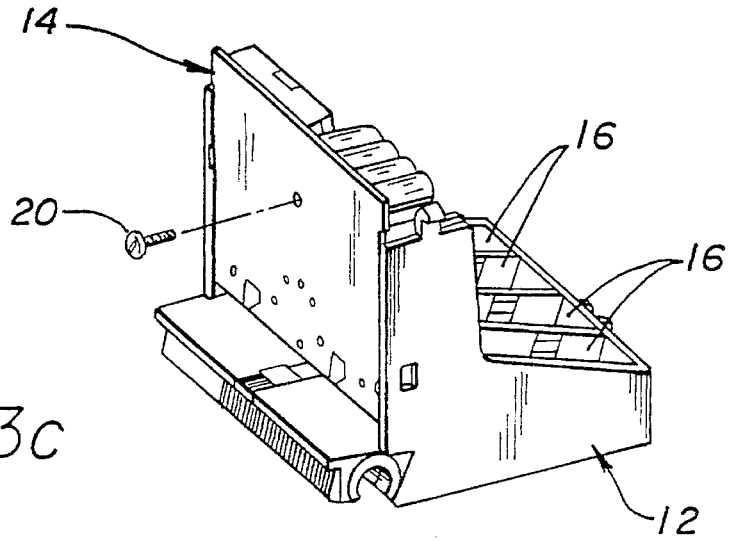

After unitary clamp assembly 28 is installed onto unitary housing 12, as shown in FIG. 2*a*, then removable frame circuit assembly 14 is placed into unitary housing 12, as shown in FIGS. 3*a* and 3*b*. Removable frame circuit assembly 14 is fastened to unitary housing 12 with a single attachment device 20, as shown in FIG. 3*c*.

Figure 4:
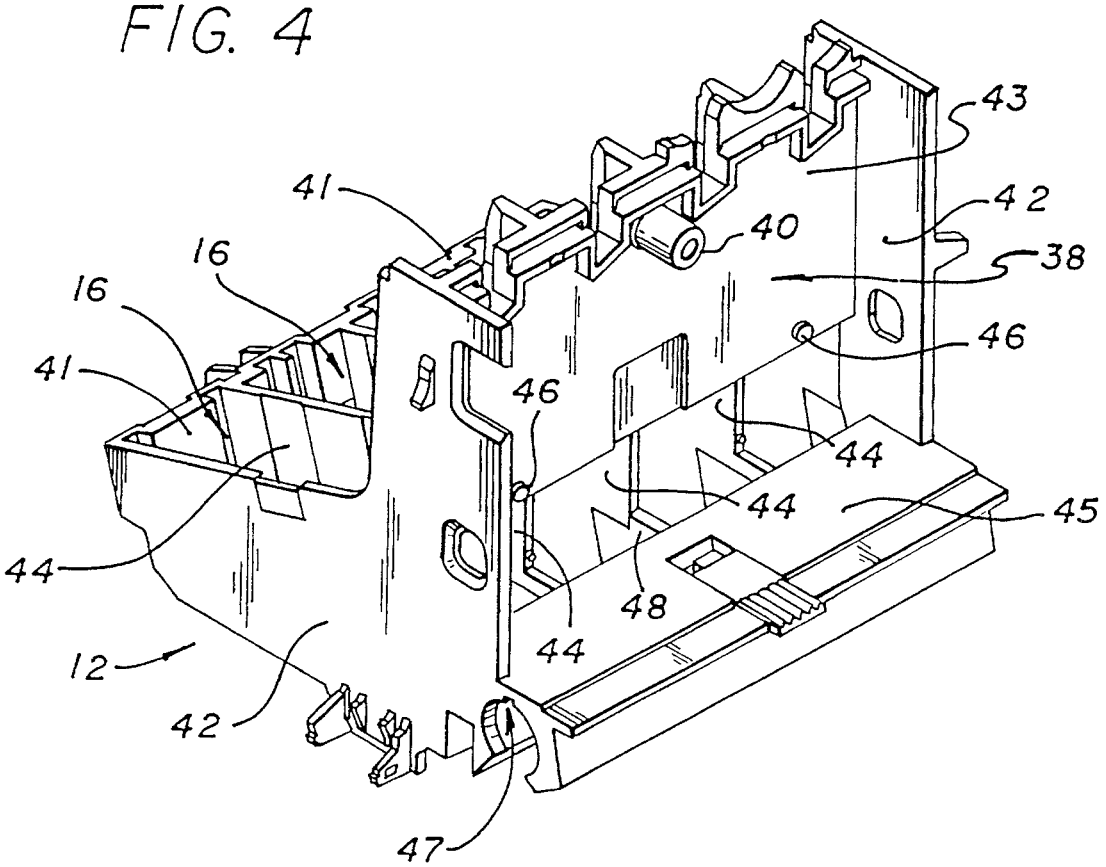
FIG. 4 is an illustrative diagram showing a unitary housing in accordance with the present invention.

FIG. 4 is an illustrative diagram showing a detailed view of the unitary housing 12 in accordance with the present invention. The unitary housing 12 is a one piece construction and retains the inkjet pens in a fixed relation to each other and the inkjet printer. A first portion 47 integral to the unitary housing extends along a first axis and is adapted to engage the carriage bar 15. The pen stalls 16 each extend along a second axis and are substantially transverse to and integral with the first portion 47. Rear compartment 38, extending along a third axis, is substantially transverse to and integral with the first and second portions and adapted to retain a substantially planar frame circuit assembly 14 within a plane defined by the first and third axes. The unitary housing provides a substantially smaller carriage assembly than the prior art.

The unitary housing 12 has a front wall 41, two lateral walls 42, three pen stall walls 44, and rear wall 43, which form four pen stalls 16. It also has a rear compartment 38 formed by lateral walls 42, rear wall 43, base 45, and the spaces between pen stall walls 44 closest to base 45. The four pen stalls 16 have passages that communicate to the rear stall between rear wall 43 and base 45 and between the pen stall walls 44. The removable frame circuit assembly 14 is installed into the rear compartment 38 in unitary housing 12, as shown in FIGS. 3*a*–3*c*. The single attachment device 20, which can be a simple screw, mates with single attachment point 40 on unitary housing 12 to attach removable frame circuit assembly 14 to unitary housing 12.

The removable frame circuit assembly 14 needs to be properly aligned to the unitary housing 12, because there are electrical contacts on the inkjet pens that when mounted in pen stalls 16 must make proper electrical contact with electrical contacts on the removable frame circuit assembly 14. The alignment of removable frame circuit assembly 14 to unitary housing 12 is provided by two vertical alignment pins 46 for vertical alignment and by single horizontal alignment wall 48 for horizontal alignment. The vertical alignment pins 46 mate with alignment holes 68 on removable frame circuit assembly 14, shown in FIG. 5*b*. The single horizontal alignment wall 48 is a vertical wall in unitary housing 12. Alignment slot 70 on removable frame circuit assembly 14, shown in FIG. 5*b*, slides over and aligns to single horizontal alignment wall 48 when the removable frame circuit assembly 14 is assembled with unitary housing 12.

Figure 5B:
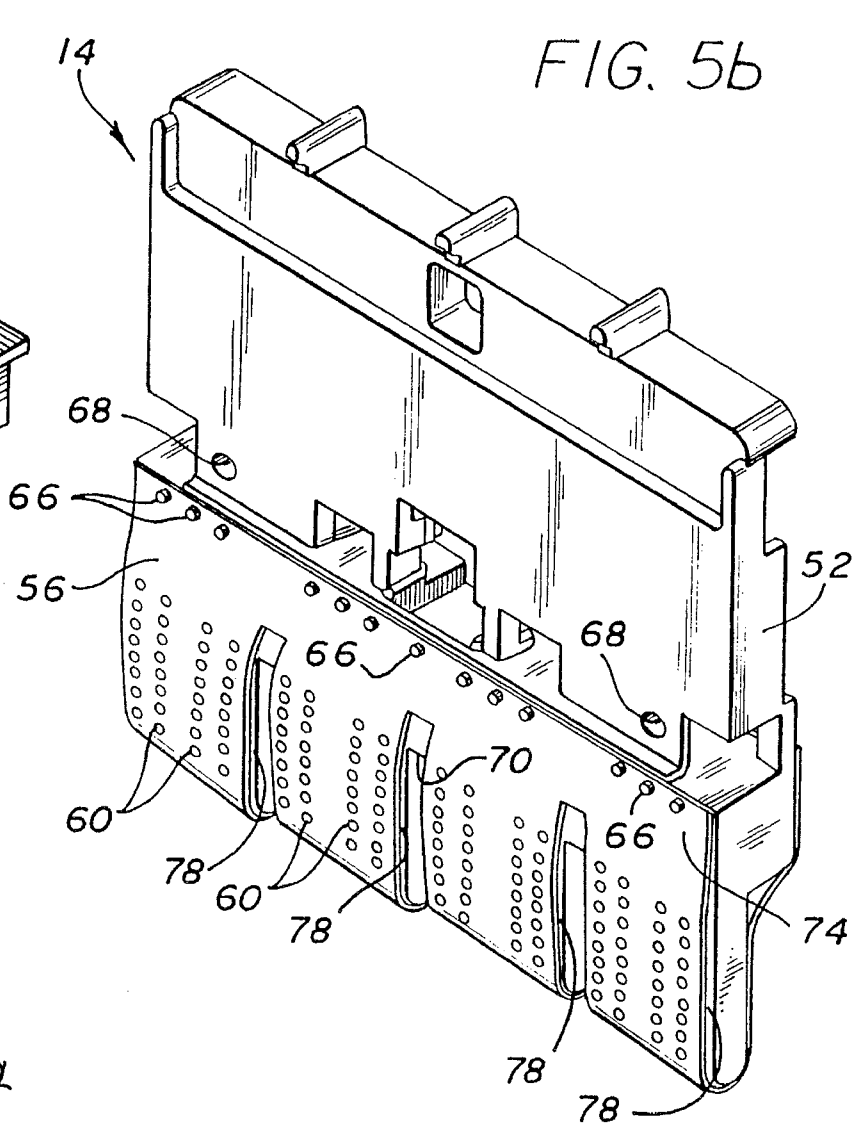
FIGS. 5*a* and 5*b* are illustrative diagrams showing the assembly of a unitary frame with a circuit board and unitary interconnect to form a removable frame circuit assembly in accordance with the present invention.
Figure 5A:
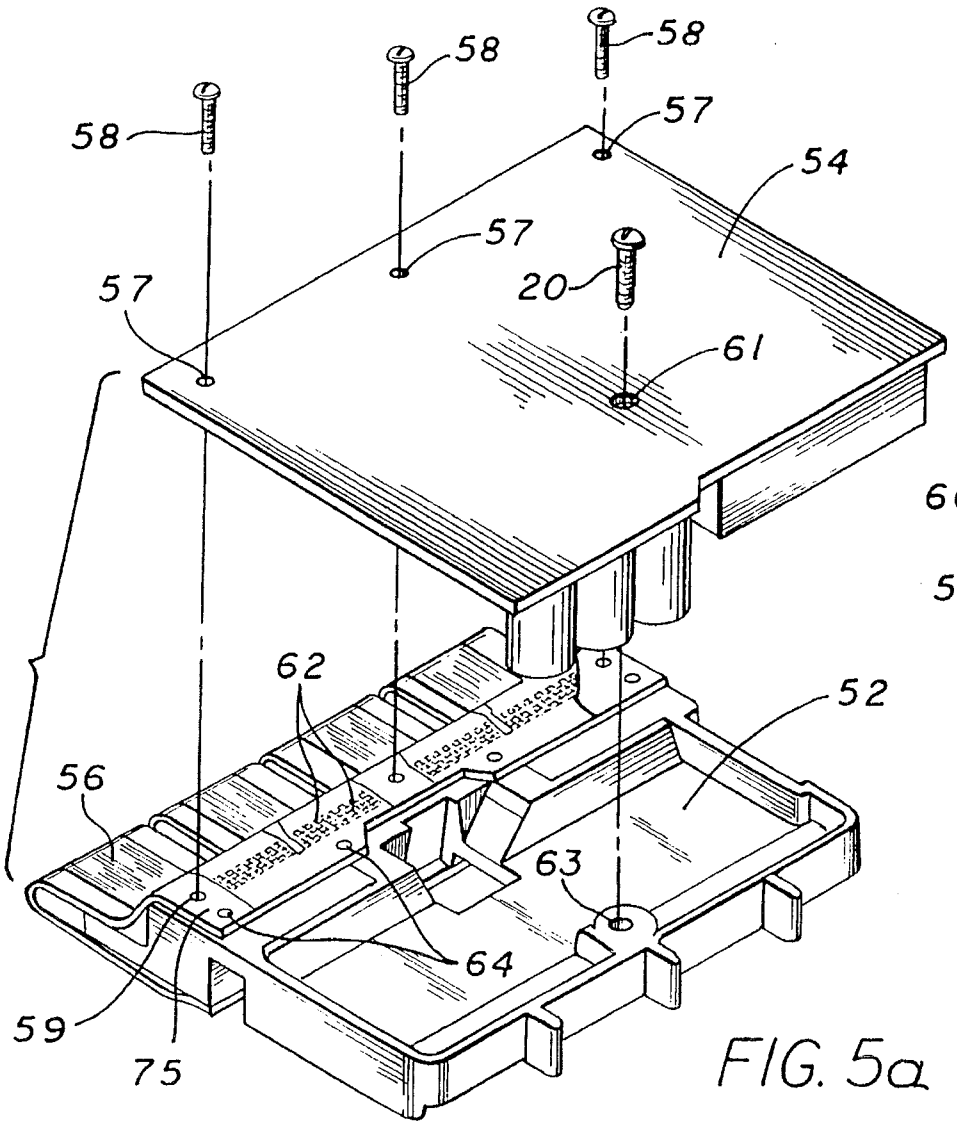
Figure 7:
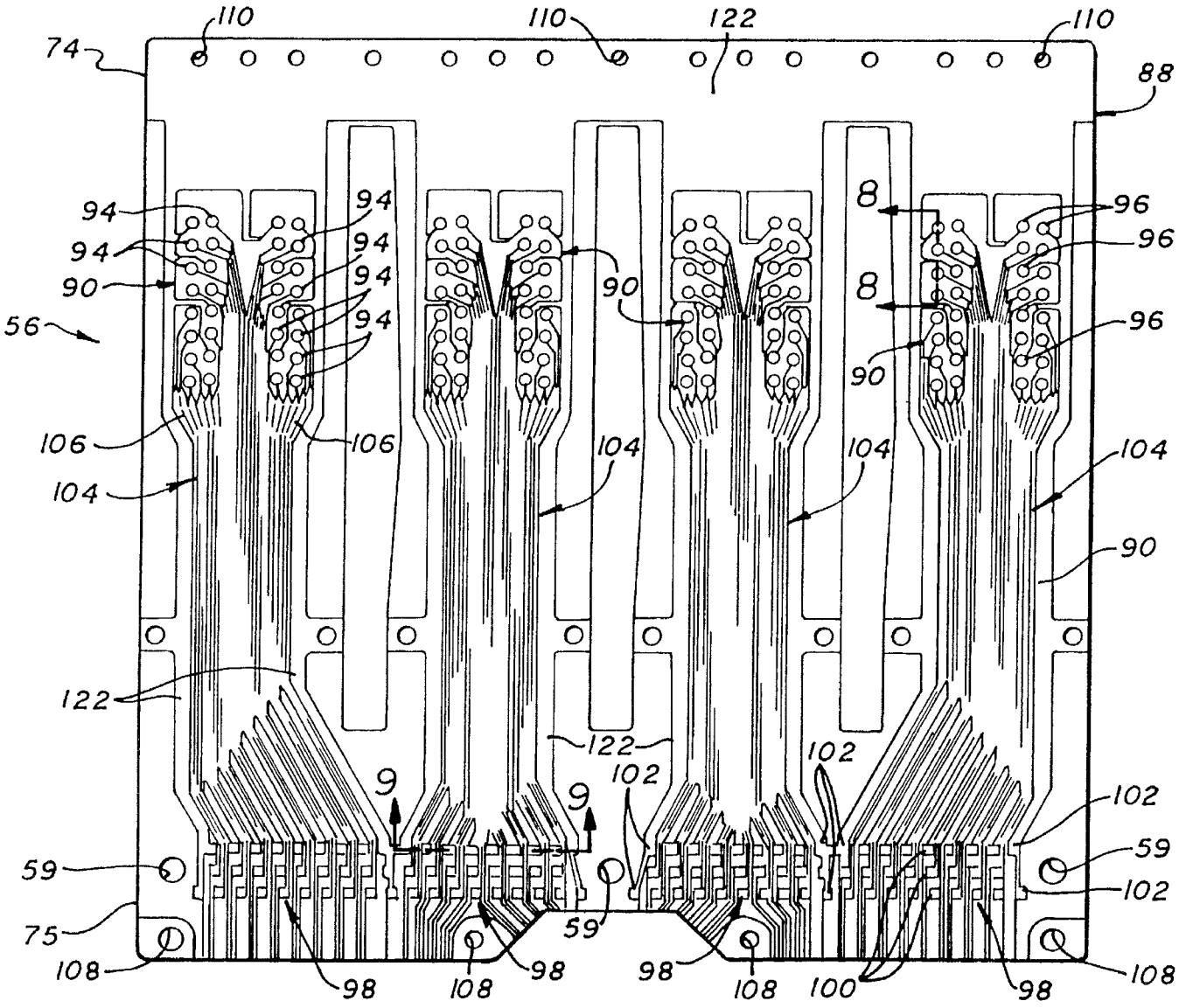
FIG. 7 is an illustrative diagram of a unitary interconnect system constructed in accordance with the present invention.

FIGS. 5*a* and 5*b* are illustrative diagrams showing the assembly of a unitary frame 52 with circuit board 54 and unitary interconnect 56 to form removable frame circuit assembly 14 in accordance with the present invention. The unitary interconnect 56 is aligned to unitary frame 52 by alignment pins 64 and unitary interconnect alignment pins 66 on unitary frame 52 that fit into alignment holes 108 and alignment holes 110, respectively, on unitary interconnect 56 as shown in FIG. 7. The unitary interconnect 56 is wrapped over extensions 78 that are on one end of unitary frame 52. When the frame circuit assembly 14 is installed into unitary housing 12, then extensions 78 slide into the passages between pen stall walls 44 and rear wall 43 and behind base 45, which positions electrical contacts 60 for interconnection with electrical contacts on the inkjet pens 22.

The unitary interconnect 56 provides a shorter interconnect between the inkjet pens 22 and the circuit board 54 than the separate flexible circuits for each inkjet pen of the prior art, which is partially a result of the substantially smaller carriage assembly provided by unitary housing 12.

The unitary interconnect 56 has two areas of electrical contacts: electrical contacts 60 on unitary interconnect first end 74 and electrical contacts 62 on unitary interconnect second end 75. The electrical contacts 62 interconnect with circuit board 54. The electrical contacts 60 are for electrical interconnection with the inkjet pens 22 held in pen stalls 16. As shown in FIG. 5*a*, the circuit board 54 is attached to the unitary frame 52 with devices such as screws 58 that pass through circuit board attachment holes 57 and unitary interconnect holes 59 and into unitary frame 52. The single attachment device 20 passes through circuit board attachment hole 61 and unitary frame hole 63, when attaching removable frame circuit assembly 14 to unitary housing 12.

Figure 6A:
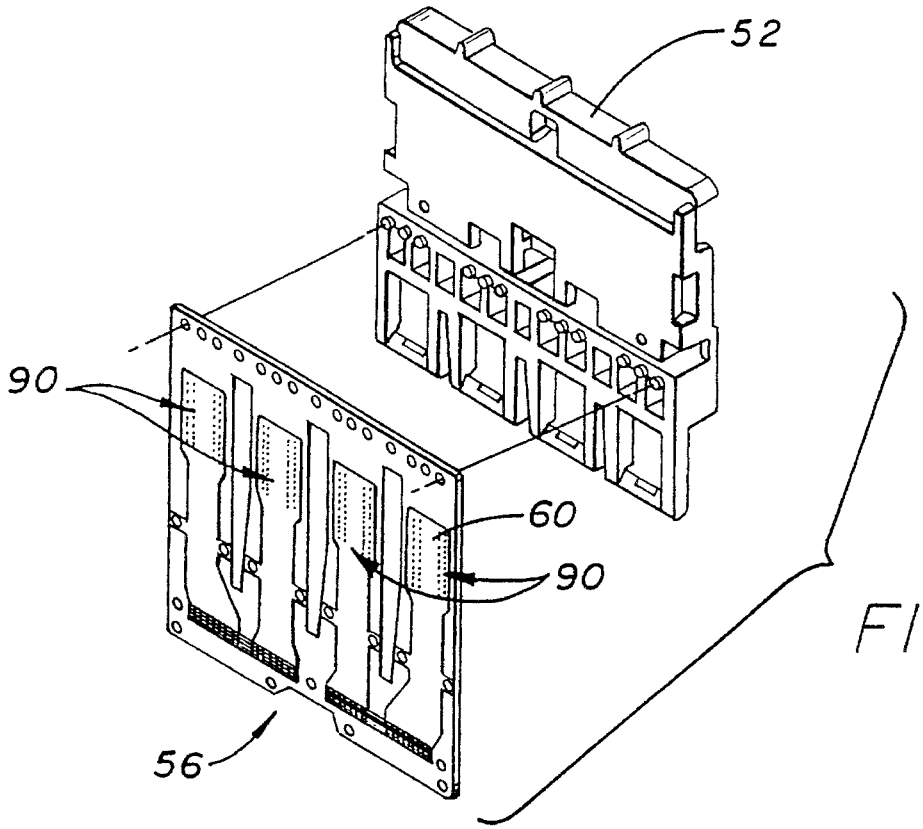
FIGS. 6*a* and 6*b* are illustrative diagrams showing the assembly of a unitary interconnect on a unitary frame with a circuit board to form a removable frame circuit assembly in accordance with the present invention.
Figure 6B:
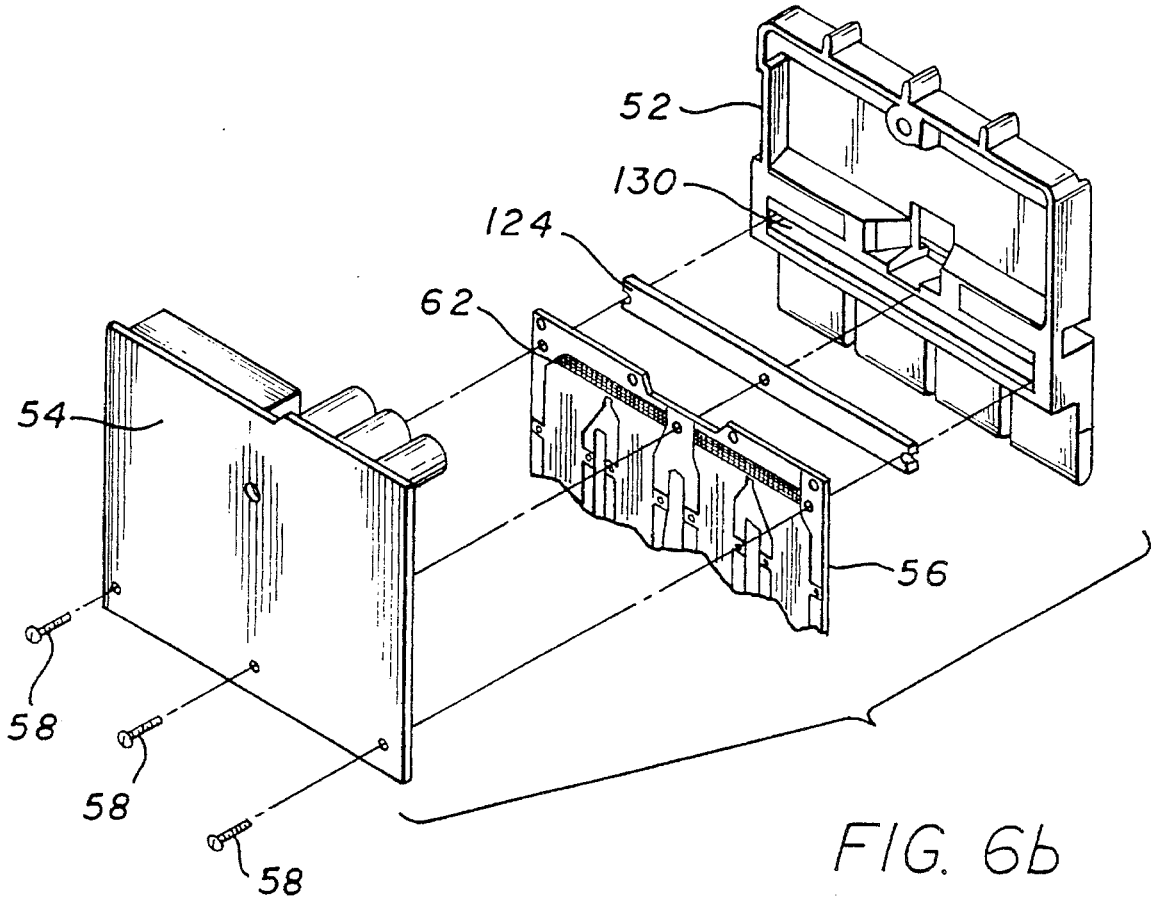

FIGS. 6*a* and 6*b* are illustrative diagrams showing the assembly of unitary interconnect 56 on unitary frame 52 and circuit board 54 to form a removable frame circuit assembly 14 in accordance with the present invention. As shown in FIG. 6*a*, the unitary interconnect 56 is first aligned and attached to unitary frame 52. Then, as shown in FIG. 6*b*, an elastomeric pad 124 is placed into recess 130 in unitary frame 52 and then the unitary interconnect 56 is wrapped over one end of unitary frame 52 and the electrical contacts 62 are aligned onto unitary frame 52 and over the elastomeric pad 124. Finally, the circuit board 54 is attached to the unitary frame 52 to make electrical contact with electrical contacts 62 on unitary interconnect 56. The electrical interconnection of the unitary interconnect 56 with the circuit board 54 is described in further detail with reference to FIG. 10 later in this specification.

FIG. 7 is an illustrative detailed diagram of the unitary interconnect 56 constructed in accordance with the present invention. The unitary interconnect 56 includes substrate 88, which for convenience of description has a unitary interconnect first end 74 and a unitary interconnect second end 75. As discussed above, there are alignment holes 108 and alignment holes 110 on substrate 88 for alignment to the unitary frame 52.

Along unitary interconnect first end 74 of substrate 88, there are four identical individual sets of electrical signal and ground contacts 90 that are for interconnection to the signal contacts on an inkjet pen. Each identical individual set of electrical signal and ground contacts 90 in FIG. 7 has twenty three electrical signal contacts 94 and nine electrical ground contacts 96. The electrical contacts 60 of FIG. 5*b* are simplified representations of the electrical signal contacts 94 and electrical ground contacts 96, as shown more accurately in FIG. 7.

At unitary substrate second end 75 of substrate 88, there are four individual sets of electrical signal contacts 98, which each have twenty three electrical signal contacts 100. The four individual sets of electrical traces 104, which each include twenty three electrical traces 106, interconnect the twenty three electrical signal contacts 94 of each of the identical individual sets of electrical signal and ground contacts 90 to the individual sets of electrical signal contacts 98. There are sixteen total electrical ground contacts 102 along the unitary interconnect second end 75 of substrate 88. The electrical contacts 62 of FIG. 5*a* are simplified representations of the electrical signal contacts 100 and electrical ground contacts 102, as shown more accurately in FIG. 7.

In an inkjet printer the number of heater circuits that are activated at any one time are determined by the pattern being printed. The advantage of the design for unitary interconnect 56 is that a common conductive ground layer 122 is used to interconnect the nine electrical ground contacts 96 for each of the four identical individual sets of electrical signal and ground contacts 90 to all sixteen electrical ground contacts 102. Thus, a total of thirty six electrical ground contacts 96 are interconnected via common conductive ground layer 122 with sixteen electrical ground contacts 102. This solves the problem of having limited interconnect area at unitary interconnect second end 75 for the electrical ground contacts 102 and allows sharing of all the electrical ground contacts 102 for the electrical ground contacts 96 of all of the inkjet pens. Thus, if a large number of heater circuits in one inkjet pen 22 are activated, then that inkjet pen can use all sixteen electrical ground contacts 102 for a ground return. Sharing the ground contacts reduces ground fluctuations for the inkjet pens and improves their performance. In a conventional device there is a separate interconnect flexible circuit for each inkjet pen 22 and therefore separate ground returns for each inkjet pen. Thus, in the conventional device each inkjet pen has a reduced number of electrical ground contacts, which can cause ground fluctuations if a large number of heater circuits are activated in one inkjet pen.

Figure 8:
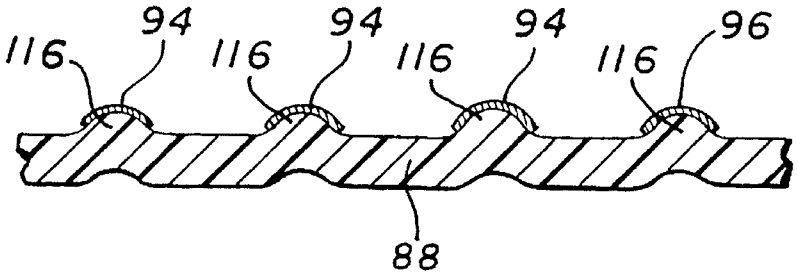
FIG. 8 is an illustrative diagram of section 8—8 of FIG. 7 showing protrusions on the unitary interconnect system for electrical signal and electrical ground contacts constructed in accordance with the present invention.
Figure 9:
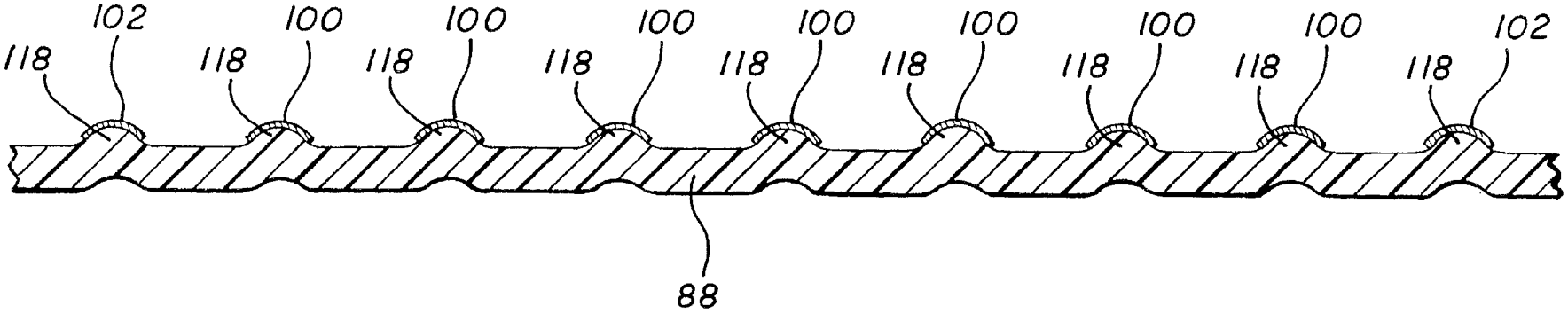
FIG. 9 is an illustrative diagram of section 9—9 of FIG. 7 showing protrusions on the unitary interconnect system for electrical signal and electrical ground contacts constructed in accordance with the present invention.

FIG. 8 is an illustrative diagram of section 8—8 of FIG. 7 showing protrusions 116 on substrate 88 constructed in accordance with the present invention. As shown in FIG. 8, there are electrical signal contacts 94 or electrical ground contacts 96 on protrusions 116. Similarly, FIG. 9 is an illustrative diagram of section 9—9 of FIG. 7 showing protrusions 118 on substrate 88. As shown in FIG. 9, there are electrical signal contacts 100 or electrical ground contacts 102 on protrusions 118. The electrical contacts on protrusions 116 make contact with electrical contacts on the inkjet pens 22 and the electrical contacts on protrusions 118 make contact with electrical contacts on circuit board 54.

Figure 10:
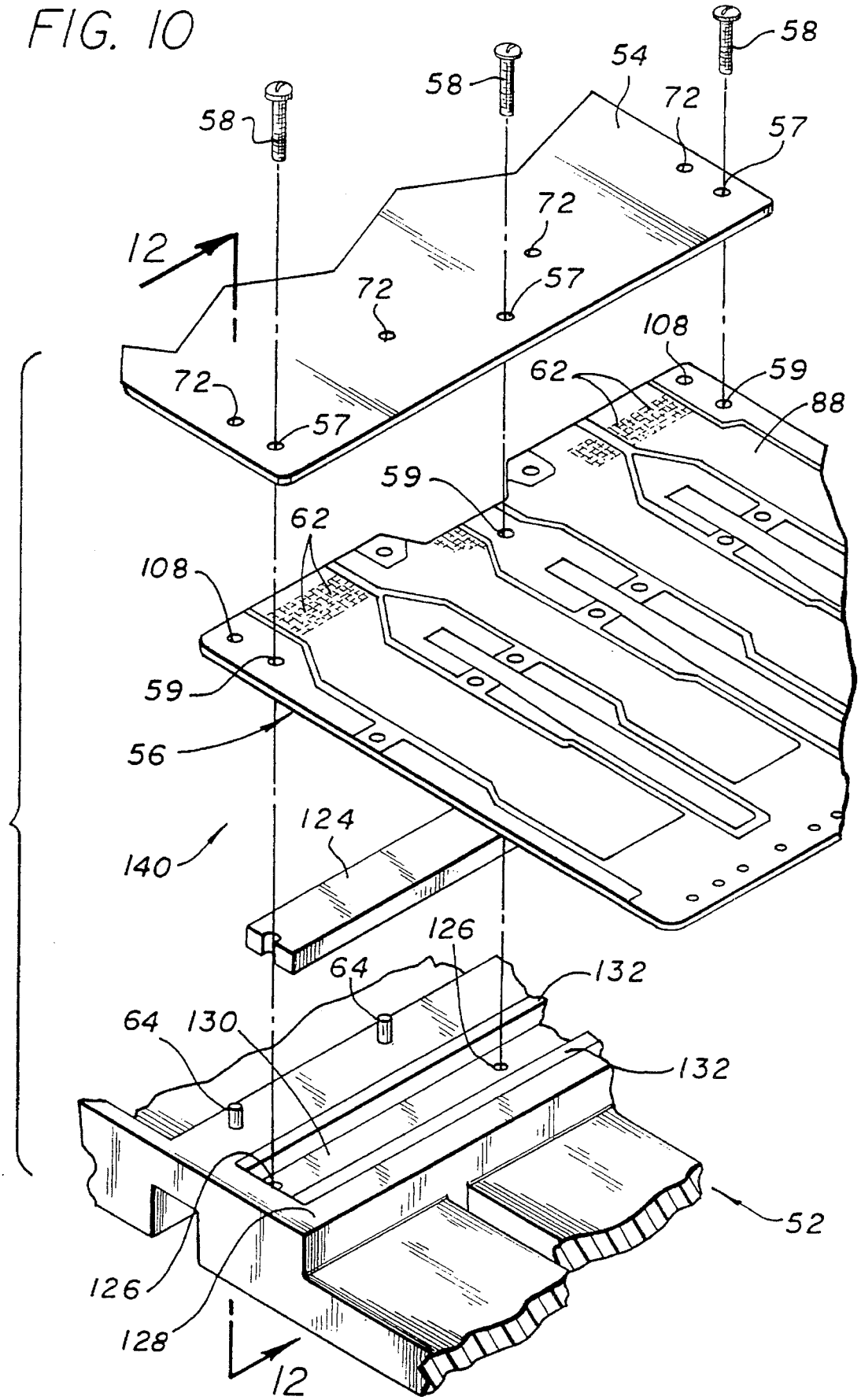
FIG. 10 is an illustrative diagram of a disassembled improved electrical interconnect system for a unitary interconnect in accordance with the present invention.

In FIG. 10 an improved electrical interconnect system 140 for a flexible circuit with a circuit board is shown. The unitary interconnect 56, shown in detail in FIG. 7, is constructed with a polyester or polyimide material such as Mylar or Kapton substrate 88 onto which multiple conductors are deposited. The conductors are made of copper and can be covered with another layer of Mylar or Kapton.

Electrical contacts 62 are located on protrusions 118 on substrate 88, as shown in FIG. 9.

FIG. 11 shows the opposite side of circuit board 54 with circuit board contacts 134, which according to the present invention are interconnected with electrical contacts 62 on unitary interconnect 56. The arrangement of circuit board contacts 134 on circuit board 54 corresponds to the arrangement of electrical contacts 62 on unitary interconnect 56, which is shown in detail in FIG. 7. Each of the circuit board contacts 134 are gold plated and the electrical contacts 62 are also gold plated to insure a low resistance electrical path.

As shown in FIG. 10, the circuit board 54 and unitary interconnect 56 are assembled on a unitary frame 52, which can be constructed of plastic, because only low pressure is used to interconnect circuit board contacts 134 and electrical contacts 62. An elastomeric pad 124, which can be constructed of urethane rubber, provides a spring function and is mounted into recess 130 in unitary frame 52. The improved electrical interconnect system 140 is assembled by using screws 58 that are inserted through circuit board attachment hole 57 on circuit board 54 and unitary interconnect holes 59 on unitary interconnect 56 and then screwed into attachment holes 126 on unitary frame 52. The electrical contacts 62 on unitary interconnect 56 are aligned to circuit board contacts 134 on circuit board 54 by alignment pins 64 coupled to unitary frame 52, which are inserted through alignment holes 108 on unitary interconnect 56 and alignment holes 72 on circuit board 54. When the improved electrical interconnect system is assembled the electrical contacts 62 are aligned and have electrical contact with circuit board contacts 134.

FIG. 12 is an illustrative diagram of an elevation section along line 12—12 of FIG. 10 of an assembled improved electrical interconnect system for a flexible circuit constructed in accordance with the present invention. In FIG. 12 the elastomeric pad 124 is shown to fit within recess 130 in unitary frame 52. The elastomeric pad 124 provides a spring function that bears upon the electrical contacts 100 on protrusions 118 between the elastomeric pad 124 and the circuit board 54. The unitary frame 52 has bevels 132 between the recess 130 and the top surface 128 of the unitary frame 52. The object of each bevel 132 is to provide relief for allowing the unitary interconnect 56 to deform during assembly so that all of the electrical contacts 100 on protrusions 118 make contact with all of the circuit board contacts 134 on circuit board 54. As the screws 58 are tightened, a portion of the unitary interconnect 56 is clamped between the top surface 128 of unitary frame 52 and the circuit board 54. Bevels 132 provide relief to the portion of unitary interconnect 56 between elastomeric pad 124 and circuit board 54.

Also shown in FIG. 12 are circuit contact recesses 136, which contain circuit board contacts 134. The circuit contact recesses 136 on circuit board 54 are the result of a coating such as a solder mask that is applied over the conductors on circuit board 54 to protect the conductors from corrosion and to prevent solder bridging. This leaves slight circuit contact recesses 136 on the order of 0.001–0.002 inches deep at each of the circuit board contacts 134, which as discussed above are gold plated. During assembly, the portion of unitary interconnect 56 between elastomeric pad 124 and circuit board 54 deforms, which allows the protrusions 118 on unitary interconnect 56 to align with the circuit contact recesses 136 on circuit board 54 to ensure proper electrical contact.

The improved electrical interconnect system for a flexible circuit 140 is easy to assemble and disassemble by simply loosening or tightening screws 58. The interconnect density exceeds 150 contacts per square inch, which provides a high density interconnect system. These desirable features are obtained while maintaining low cost and high reliability.

The improved unitary interconnect system provides an interconnect system that reduces cost, is easier to assemble and align, and provides ground plane sharing for all of the inkjet pens.

The improved carriage assembly has reduced cost and is easier to assemble, align and service without the need for any special tools.

Thus, the present invention has been described herein with reference to a particular embodiment for a particular application. Nonetheless, those having ordinary skill in the art and access to present teachings will recognize additional modifications, applications, and embodiments within the scope thereof. For example, the alignment pins of the present invention may be replaced by other equivalent devices without departing from the scope of the present invention.

It is therefore intended by the appended claims to cover any and all such applications, modifications and embodiments within the scope of the present invention.

Accordingly,

What is claimed is:

1. An improved modular carriage assembly for an inkjet printer comprising:

a carriage with at least two stalls molded therein for holding a plurality of inkjet pens; and a removable frame having at least two extensions molded thereon which is separable from the inkjet pens and is insertable into a compartment in said carriage adjacent to said stall means for holding an electrical circuit assembly, wherein when said removable frame is inserted into said compartment each of said extensions is inserted into a respective stall means.

2. The improved modular carriage assembly of claim 1 wherein said electrical circuit assembly comprises:

a printed circuit coupled to said removable frame for interfacing to said inkjet pens; and an interconnect circuit coupled to said printed circuit and wrapped around said extensions for interconnecting said printed circuit to said inkjet pens.

3. The improved modular carriage assembly of claim 2 further comprising:

a single attachment means for coupling said printed circuit to said removable frame and for coupling said removable frame to said compartment in said carriage.

4. The improved modular carriage assembly of claim 3 further comprising:

a unitary clamp means attached to said carriage for holding said inkjet pens in said carriage.

5. The improved modular carriage assembly of claim 4 further comprising:

two alignment pins coupled to said compartment for vertical alignment of said removable frame in said compartment;

single wall means coupled to said compartment for horizontal alignment of said removable frame in said compartment; and a single alignment slot between two of said extensions for aligning said removable frame in said compartment on said single wall means.

6. The improved modular carriage assembly of claim 5 further comprising:

alignment means for aligning said interconnect means to said removable frame coupled to said removable frame and to said interconnect means.

7. An improved carriage of one piece construction for retaining at least two inkjet print cartridges in a fixed relation comprising:

a first portion extending along a first axis and adapted to engage a carriage bar of an inkjet printer along said first axis;

at least two second portions, each extending along a second axis, substantially transverse to and integral with said first portion, for retaining said first and second inkjet print cartridges in a fixed relation; and a third portion, extending along a third axis, substantially transverse to and integral with said first portion and second portions and adapted to retain a substantially planar removable element within a plane defined by said first and third axes, the substantially planar removable element comprising a removable frame having at least two extensions molded thereon which is separable from said inkjet print cartridges for holding an electrical circuit means insertable into said third portion, wherein when said removable frame is inserted into said third portion each of said extensions is inserted into a respective said second portion.

8. The improved modular carriage assembly of claim 7 further comprising:

a printed circuit coupled to said removable frame for interfacing to said inkjet pens; and an interconnect circuit coupled to said printed circuit and wrapped around said extensions for interconnecting said printed circuit to said inkjet pens.

9. An improved modular carriage assembly for an inkjet printer comprising:

a carriage with at least two stall means molded therein for holding a plurality of inkjet pens;

a removable frame insertable in a compartment in said carriage adjacent to said stall means for holding an electrical circuit assembly;

at least two extensions molded into said removable frame;

wherein when said removable frame is inserted into said compartment each of said extensions is inserted into a respective said stall means;

a printed circuit coupled to said removable frame for interfacing to said inkjet pens; and an interconnect circuit coupled to said printed circuit and wrapped around said extensions for interconnecting said printed circuit to said inkjet pens; and a single attachment means for coupling said printed circuit to said removable frame and for coupling said removable frame to said compartment in said carriage.

10. The improved modular carriage assembly of claim 9 further comprising:

alignment means for aligning said interconnect means to said removable frame coupled to said removable frame and to said interconnect means.

* * * * *